US011339785B2

(12) United States Patent
Choi et al.

(10) Patent No.: US 11,339,785 B2
(45) Date of Patent: May 24, 2022

(54) SCROLL COMPRESSOR WITH RECESSES AND PROTRUSIONS

(71) Applicant: LG ELECTRONICS INC., Seoul (KR)

(72) Inventors: Yongkyu Choi, Seoul (KR); Cheolhwan Kim, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 120 days.

(21) Appl. No.: 15/956,970

(22) Filed: Apr. 19, 2018

(65) Prior Publication Data

US 2018/0238327 A1 Aug. 23, 2018

Related U.S. Application Data

(63) Continuation of application No. 14/708,436, filed on May 11, 2015, now Pat. No. 9,951,773.

(30) Foreign Application Priority Data

Aug. 19, 2014 (KR) ..... 10-2014-0107929

(51) Int. Cl.
*F04C 18/02* (2006.01)
*F04C 23/00* (2006.01)

(52) U.S. Cl.
CPC ..... *F04C 18/0269* (2013.01); *F04C 18/0215* (2013.01); *F04C 23/008* (2013.01)

(58) Field of Classification Search
CPC ..... F04C 18/0269
See application file for complete search history.

(56) References Cited

U.S. PATENT DOCUMENTS 5,591,022 A 1/1997 Protos
6,527,526 B2 3/2003 Chang
(Continued)

FOREIGN PATENT DOCUMENTS

JP 2004-019527 1/2004
JP 2007-002736 1/2007
(Continued)

OTHER PUBLICATIONS

Chinese Office Action dated Mar. 2, 2017 issued in Application No. 201510289406.0 (with translation).
(Continued)

*Primary Examiner* — Mary Davis
(74) *Attorney, Agent, or Firm* — Ked & Associates LLP

(57) ABSTRACT

A compressor is provided. The compressor may include a fixed wrap, and an orbiting scroll having an orbiting wrap engaged with the fixed wrap to form compression chambers. The fixed wrap and the orbiting wrap may have irregular wrap curves. At least one interference avoiding portion at which a spacing between the wraps is greater than an orbiting radius or at least one gap compensating portion at which the spacing between the wraps is smaller than the orbiting radius, in a state in which a center of the fixed scroll and a center of the orbiting scroll are aligned with each other, may be provided on a sidewall surface of the fixed wrap or the orbiting wrap, whereby frictional loss or abrasion due to interference between the wraps or a refrigerant leakage due to a gap between the wraps may be prevented.

16 Claims, 5 Drawing Sheets

(56) References Cited

U.S. PATENT DOCUMENTS

| | | | | |
|---|---|---|---|---|
| 6,776,592 | B2 | 8/2004 | Nakane | |
| 8,512,017 | B2 | 8/2013 | Yamamoto | |
| 9,657,738 | B2 * | 5/2017 | Bonnefoi | F04C 29/023 |
| 9,951,773 | B2 * | 4/2018 | Choi | F04C 18/0269 |
| 2004/0062671 | A1 * | 4/2004 | Suefuji | F04C 18/0269 418/55.2 |
| 2010/0284845 | A1 | 11/2010 | Taniguchi et al. | |
| 2013/0089449 | A1 | 4/2013 | Seong | |
| 2015/0337838 | A1 | 11/2015 | Sung | |

FOREIGN PATENT DOCUMENTS

| | | |
|---|---|---|
| JP | 3991810 | 10/2007 |
| JP | 103016342 | 4/2013 |
| KR | 10-0192067 | 6/1999 |
| KR | 10-2009-0012618 | 2/2009 |
| KR | 10-2013-0003960 | 1/2013 |

OTHER PUBLICATIONS

U.S. Office Action issued in U.S. Appl. No. 14/708,436 dated Mar. 24, 2017.

U.S. Final Office Action issued in U.S. Appl. No. 14/708,436 dated Aug. 30, 2017.

Korean Notice of Allowance dated Feb. 1, 2021 issued in Application No. 10-2014-0107929 (English translation attached).

* cited by examiner

SCROLL COMPRESSOR WITH RECESSES AND PROTRUSIONS

CROSS-REFERENCE TO RELATED APPLICATIONS

This application is a Continuation Application of prior U.S. patent application Ser. No. 14/708,436 filed May 11, 2015, which claims priority under 35 U.S.C. § 119 to Korean Application No. 10-2014-0107929, filed on Aug. 19, 2014, whose entire disclosures are hereby incorporated by reference.

BACKGROUND

1. Field

A scroll compressor is disclosed herein.

2. Background

In general, scroll compressors are widely used for refrigerant compression in air-conditioners, to obtain a relatively higher compression ratio in comparison to other types of compressors, and acquire a stable torque resulting from smooth strokes of suction, compression, and discharge of the refrigerant. A behavior of the scroll compressor is dependent on shapes of a fixed wrap and an orbiting wrap. The fixed wrap and the orbiting wrap may have a random shape, but typically they have a shape of an involute curve, which is easy to manufacture. An involute curve refers to a curve corresponding to a track drawn by an end of a thread when unwinding the thread wound around a basic circle with a predetermined radius. When such an involute curve is used, the wrap has a uniform thickness, and a rate of volume change of the compression chamber is constantly maintained. Hence, a number of turns of the wrap should be increased to obtain a sufficient compression ratio, which may, however, cause the compressor to be increased in size corresponding to the increased number of turns of the wrap.

The scroll compressor may be provided with a rotation-preventing member, such as an Oldham ring, provided between the orbiting scroll and a frame that supports the orbiting scroll or a fixed scroll, so as to induce an orbiting motion by preventing rotation of the orbiting scroll. However, when the Oldham ring is provided in the scroll compressor, a gap is formed between a key and a key groove, which are located at or on the Oldham ring and the orbiting scroll, respectively. The gap may cause the orbiting scroll to be temporarily rotated or inversely rotated during operation. Due to the rotation or inverse rotation of the orbiting scroll, an interference or gap may be formed between an orbiting wrap and a fixed wrap according to a crank angle in each of a compression chamber (hereinafter, referred to as "a first compression chamber") formed outside of the orbiting wrap, and a compression chamber (hereinafter, referred to as a "second compression chamber") formed inside of the orbiting wrap. This results from the fact that an orbiting radius of the orbiting wrap changes without remaining still at a moment of the rotation or the inverse rotation of the orbiting scroll. When the fixed wrap and the orbiting wrap have an involute or algebraic spiral shape, in which a wrap curve of the fixed wrap and the orbiting wrap has a uniform shape along a turning direction of the wrap, the interference or gap is minorly generated. However, in a scroll compressor in which the wrap curve of the fixed wrap and the orbiting wrap is irregular in the turning direction of the wrap, a great interference or gap may be generated. In this manner, if such interference or gap is generated at a specific portion between the orbiting wrap of the orbiting scroll and the fixed wrap of the fixed scroll, abrasion due to interference between the wraps or compression loss due to the gap between the wraps may be caused.

BRIEF DESCRIPTION OF THE DRAWINGS

Embodiments will be described in detail with reference to the following drawings in which like reference numerals refer to like elements, and wherein.

DETAILED DESCRIPTION

Figure 1:
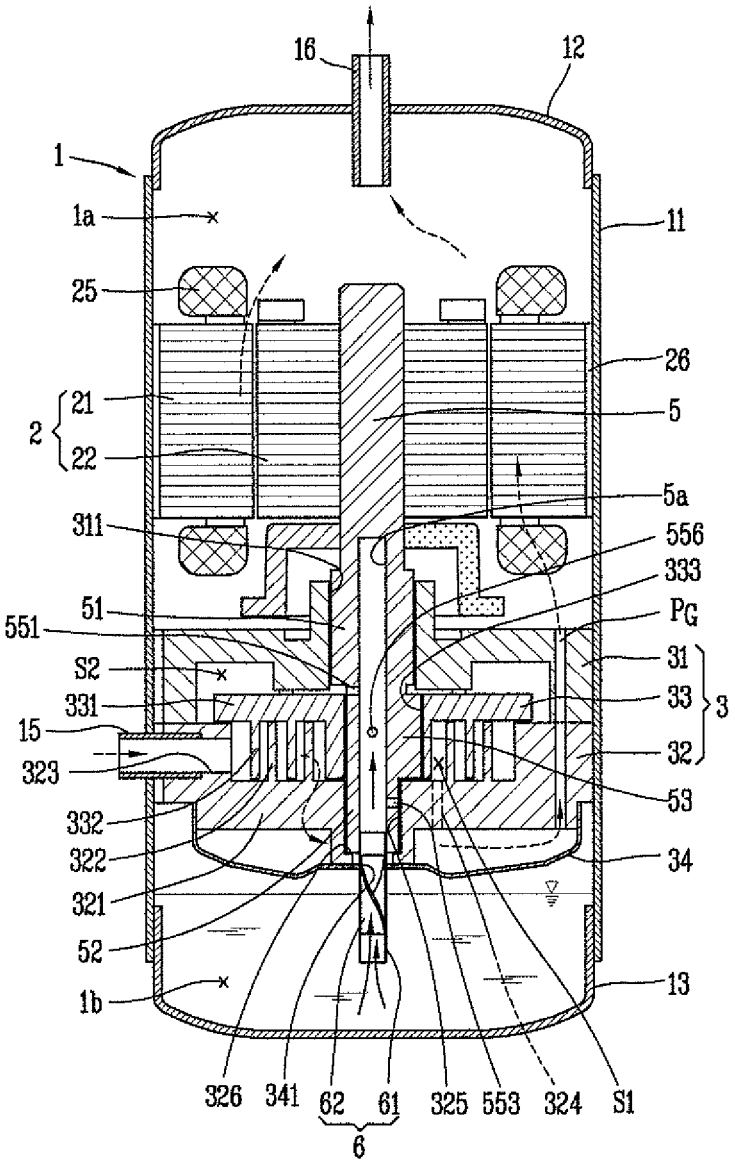
FIG. 1 is a longitudinal sectional view of a bottom compression type scroll compressor according to an embodiment.

Hereinafter, description will be given in detail of a scroll compressor according to an embodiment with reference to the accompanying drawings. Where possible, like reference numerals have been used to indicate like elements, and repetitive disclosure has been omitted.

Figure 2:
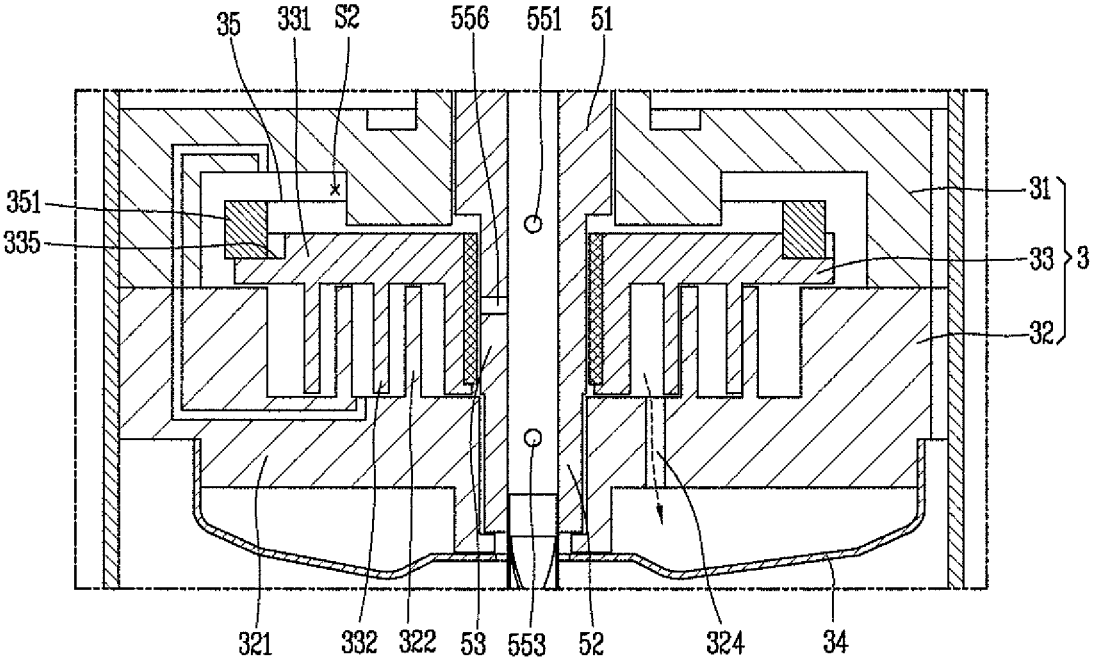
FIG. 2 is an enlarged longitudinal sectional view of a compression device of the bottom compression type scroll compressor of FIG. 1.

FIG. 1 is a longitudinal sectional view of a bottom compression type scroll compressor according to an embodiment. FIG. 2 is an enlarged longitudinal sectional view of a compression device of the bottom compression type scroll compressor of FIG. 1.

The bottom compression type scroll compressor according to an embodiment may include a casing 1, a motor 2 provided within an inner space 1*a* of the casing 1 to generate a rotational force, and a compression device 3 provided below the motor 2 to compress a refrigerant by receiving the rotational force transferred from the motor 2. The casing 1 may include a cylindrical shell 11 that forms a hermetic container, an upper shell 12 that covers a top of the cylindrical shell 11 to form the hermetic container, and a lower shell 13 that covers a bottom of the cylindrical shell 11 to form the hermetic container and simultaneously form an oil storage space 1*b*.

A refrigerant suction pipe 15 may penetrate through a side surface of the cylindrical shell 11 to communicate directly with a suction chamber of the compression device 3, and a refrigerant discharge pipe 16 that communicates with the inner space 1*a* of the casing 1 may be provided at a top of the upper shell 12. The refrigerant suction pipe 16 may correspond to a path along which a compressed refrigerant, which may be discharged from the compression device 3 into the inner space 1*a* of the casing 1, may be discharged to the outside. An oil separator (not illustrated), in which oil mixed with the discharged refrigerant may be separated from the refrigerant, may be connected to the refrigerant discharge pipe 16.

A stator 21 that forms the motor 2 may be fixed to an upper portion of the casing 1. A rotor 22 that forms the motor 2 together with the stator 21 and is rotated by interaction with the stator 21 may be rotatably provided within the stator 21.

The stator 21 may be provided with a plurality of slots (no reference numeral) formed on an inner circumferential surface thereof along a circumferential direction. A coil 25 may be wound around each of the plurality of slots. A passage 26 may be formed, for example, by cutting an outer circumferential surface of the stator 21 into a D-cut shape, such that a refrigerant or oil may flow between the outer circumferential surface of the stator 21 and an inner circumferential surface of the cylindrical shell 11.

A main frame 31 that forms the compression device 3 may be provided below the stator 21 with a predetermined gap therebetween, and fixed to a lower side of the casing 1. A fixed scroll 32 (hereinafter, also referred to as a "first scroll") may be fixed to a lower surface of the main frame 31 with an orbiting scroll 33 (hereinafter, also referred to as a "second scroll"), which may be eccentrically coupled to a rotational shaft 5, which is discussed hereinbelow, interposed therebetween. The orbiting scroll 33 may be installed between the main frame 31 and the fixed scroll 32 to perform an orbiting motion. The orbiting scroll 33 may form a plurality of compression chambers S1, which may include a suction chamber, an intermediate pressure chamber, and a discharge chamber, along with the fixed scroll 32 while performing the orbiting motion. The fixed scroll 32 may be coupled to the main frame 31 to be movable up and down.

The main frame 31 may have an outer circumferential surface, which may be shrink-fitted or welded onto the inner circumferential surface of the cylindrical shell 11, for example. A first bearing hole 311 may be formed through a center of the main frame 31 in an axial direction. A main bearing 51 of the rotational shaft 5, which may correspond to a first bearing, may be rotatably inserted into the first bearing hole 311 and be supported thereby. A back pressure chamber 82, which may form a space along with the fixed scroll 32 and the orbiting scroll 33 so as to support the orbiting scroll 33 by pressure of the space, may be formed at a lower surface of the main frame 31.

The fixed scroll 32 may include a disk 321 formed in an approximately circular shape, and a fixed wrap 322, which may be formed on an upper surface of the disk 321 and engaged with an orbiting wrap 332, which is discussed hereinbelow, so as to form the compression chambers S1. A suction opening 323, which may be connected to the refrigerant suction pipe 15, may be formed at one side of the fixed wrap 322. A discharge opening 324, which may communicate with the discharge chamber, such that a compressed refrigerant may be discharged therethrough, may be formed through the disk 321.

The discharge opening 324 may be formed to extend toward the lower shell 13, and a discharge cover 34 may be coupled to a lower surface of the fixed scroll 32 so as to store the discharged refrigerant and guide it toward a refrigerant passage, which will be discussed hereinbelow. The discharge cover 34 may be coupled to the lower surface of the fixed scroll 32 in a sealing manner so as to separate a discharge passage (no reference numeral) of the refrigerant from the oil storage space 1*b*.

The discharge cover 34 may have an inner space, in which both the discharge opening 324 and an inlet of a refrigerant passage $P_G$ may be accommodated. The refrigerant passage $P_G$ may be formed through the fixed scroll 32 and the main frame 31 so as to guide a refrigerant, which may be discharged from the compression chambers S1 into the inner space of the discharge cover 34, toward the upper inner space 1*a* of the casing 1. The discharge cover 34 may be provided with a through hole 341, through which an oil feeder 6 may be inserted. The oil feeder 6 may be coupled to a sub bearing 52 of the rotational shaft 5, which will be discussed hereinbelow, corresponding to a second bearing, and sunk in the oil storage space 1*b* of the casing 1.

A second bearing hole 325, through which the sub bearing 52 of the rotational shaft 5 may be penetratingly coupled, may be formed in an axial direction through a central portion of the disk 321 of the fixed scroll 32. A thrust bearing 326, which may support a lower end of the sub bearing 52 in the axial direction, may protrude from an inner circumferential surface of the second bearing hole 325.

The orbiting scroll 33 may include a disk 331 formed in an approximately circular shape, and the orbiting wrap 332 may be formed on a lower surface of the disk 331 and be engaged with the fixed wrap 322 to form the compression chambers S1. A rotational shaft coupling portion 333, in which an eccentric portion 53 of the rotational shaft 5, which will be discussed hereinbelow, may be rotatably inserted, may be formed in the axial direction through a central portion of the disk 331. An outer circumference of the rotational shaft coupling portion 333 may be connected to the orbiting wrap 332 so as to form the compression chambers S1 along with the fixed wrap 322 during compression.

The eccentric portion 53 of the rotational shaft 5, which will be discussed hereinbelow, may be inserted into the rotational shaft coupling portion 333, so as to overlap the orbiting wrap 332 or the fixed wrap 322 in a radial direction of the compressor. Accordingly, a repulsive force of a refrigerant may be applied to the fixed wrap 322 and the orbiting wrap 332 upon compression, and a compression force as a reaction force may be applied between the rotational shaft coupling portion 333 and the eccentric portion 53. In such a manner, when the eccentric portion 53 of the rotational shaft 5 penetrates through the disk 331 of the orbiting scroll 33 and overlaps the orbiting wrap 332 in the radial direction, the repulsive force and the compression force may be applied to or at a same plane based on the disk, thereby being attenuated by each other. This may result in preventing the orbiting scroll 33 from being inclined due to the applied compression force and repulsive force.

The rotational shaft 5 may have an upper portion press-fitted into a center of the rotor 22 and a lower portion coupled to the compression device 3, so as to be supported in the radial direction. Accordingly, the rotational shaft 5 may transfer a rotational force of the motor 2 to the orbiting scroll 33 of the compression device 3. The orbiting scroll 33, which may be eccentrically coupled to the rotational shaft 5, may thus orbit with respect to the fixed scroll 32.

The main bearing 51, which may be inserted into the first bearing hole 311 of the main frame 31 to be supported in the radial direction, may be formed at a lower portion of the rotational shaft 5, and the sub bearing 52, which may be inserted into the second bearing hole 325 of the fixed scroll 32 to be supported in the radial direction, may be formed at a lower side of the main bearing 51. The eccentric portion 53, which may be coupled to the rotational shaft coupling portion 333 of the orbiting scroll 33 in an inserting manner, may be formed between the main bearing 51 and the sub bearing 52. The main bearing 51 and the sub bearing 52 may be coaxially formed to have a same axial center, and the eccentric portion 53 may be eccentric from the main bearing 51 or the sub bearing 52 in the radial direction. The sub bearing 52 may also be formed to be eccentric from the main bearing 51.

The eccentric portion 53 may have an outer diameter which may be smaller than an outer diameter of the main bearing 51 and greater than an outer diameter of the sub bearing 52, which may be advantageous in view of coupling the rotational shaft 5 through the bearing holes 311, 325 and the rotational shaft coupling portion 333. However, when the eccentric portion 53 is not integrally formed with the rotational shaft 5, but rather, is formed using a separate bearing, insertion of the rotational shaft 5 for coupling may be enabled even though the outer diameter of the sub bearing 52 is not smaller than the outer diameter of the eccentric portion 53.

An oil passage 5*a*, through which oil may be supplied to each bearing and the eccentric portion 53, may be formed within the rotational shaft 5. As the compression device 3 is located lower than the motor 2, the oil passage 5*a* may be formed in a recessing manner from a lower end of the rotational shaft 5 up to an approximately lower end or an intermediate height of the stator 21, or up to a height higher than an upper end of the main bearing 51.

The oil feeder 6 to pump up oil filled in the oil storage space 1*b* may be coupled to a lower end of the rotational shaft 5, namely, a lower end of the sub bearing 52. The oil feeder 6 may be provided with an oil supply pipe 61, which may be inserted into the oil passage 5*a* of the rotational shaft 5 for coupling, and an oil sucking member 62, such as a propeller, may be inserted into the oil supply pipe 61 to suck up the oil. The oil supply pipe 61 may be inserted through the through hole 341 of the discharge cover 34 so as to be sunk into the oil storage space 1*b*.

Unexplained reference numeral 35 denotes an Oldham ring, 351 denotes a key of the Oldham ring 35, 335 denotes a key groove of the orbiting scroll 33, and 551, 553, and 556 denote oil-feeding holes, respectively.

Operation of the scroll compressor according to this embodiment will be discussed as follows.

That is, when power is applied to the motor 2 so as to generate a rotational force, the rotational shaft 5 coupled to the rotor 22 of the motor 2 may be rotated. In response, the orbiting scroll 33 coupled to the eccentric portion 53 of the rotational shaft 5 may continuously move while performing an orbiting motion, thereby forming between the orbiting wrap 332 and the fixed wrap 322 the plurality of compression chambers S1, which may include a suction chamber, an intermediate pressure chamber, and a discharge chamber. The compression chambers S1 may be continuously formed through several stages while their volumes are gradually decreased toward a central direction.

Accordingly, a refrigerant, which may be supplied from outside of the casing 1 through the refrigerant suction pipe 15, may be introduced directly into the compression chambers S1. The refrigerant may be compressed while moving toward the discharge chamber of the compression chambers S1 in response to the orbiting motion of the orbiting scroll 33, and then, may be discharged from the discharge chamber into the inner space 1*a* of the discharge cover 34 through the discharge opening 324 of the fixed scroll 32.

The compressed refrigerant discharged into the inner space 1*a* of the discharge cover 34 may be then be discharged into the inner space 1*a* of the casing 1 through the refrigerant passage $P_G$, which may be formed along the fixed scroll 32 and the main frame 31, thereby being discharged out of the casing 1 through the refrigerant discharge pipe 16. This series of processes may be repeated.

Figure 3:
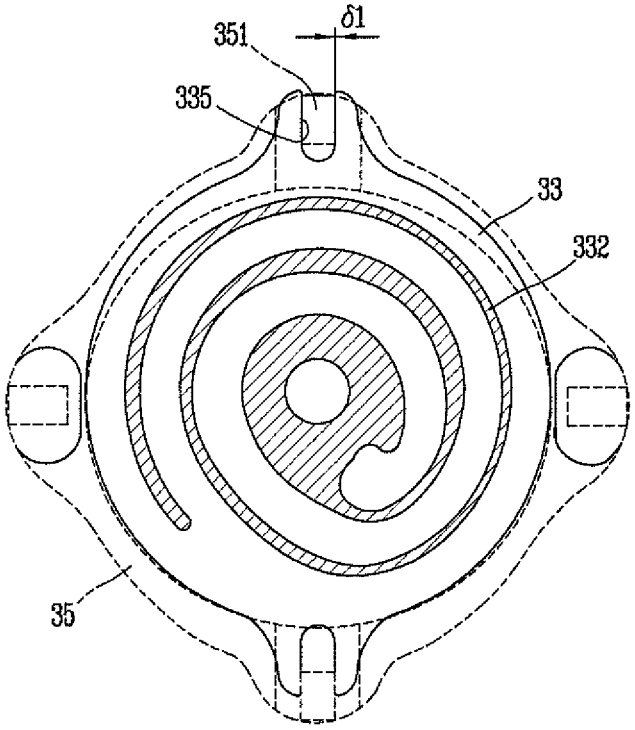
FIG. 3 is a planar view illustrating a coupled state of an Oldham ring to an orbiting scroll in the bottom compression type scroll compressor illustrated in FIG. 1.

With coupling the Oldham ring 35 between the main frame 31 and the orbiting scroll 33, the orbiting scroll 33 may perform an orbiting motion with respect to the main frame 31 or the fixed scroll 32 while its rotation is prevented. However, the Oldham ring 35 and the orbiting scroll 33, as illustrated in FIGS. 2 and 3, may be coupled by virtue of the keys 351 and the key grooves 335. The keys 351 and the key grooves 335 may be spaced apart from each other by a clearance gap 51 of, for example, about 20 to about 100 μm, such that the orbiting scroll 33 may smoothly slide to perform the orbiting motion. The clearance gap 61 may allow the orbiting scroll 33 to generate a rotational moment or an inverse rotational moment during operation. This may result in generation of an interference section ④ and gap sections ①, ②, ③, ⑤ and ⑥ between the orbiting wrap 332 and the fixed wrap 322.

Figure 4:
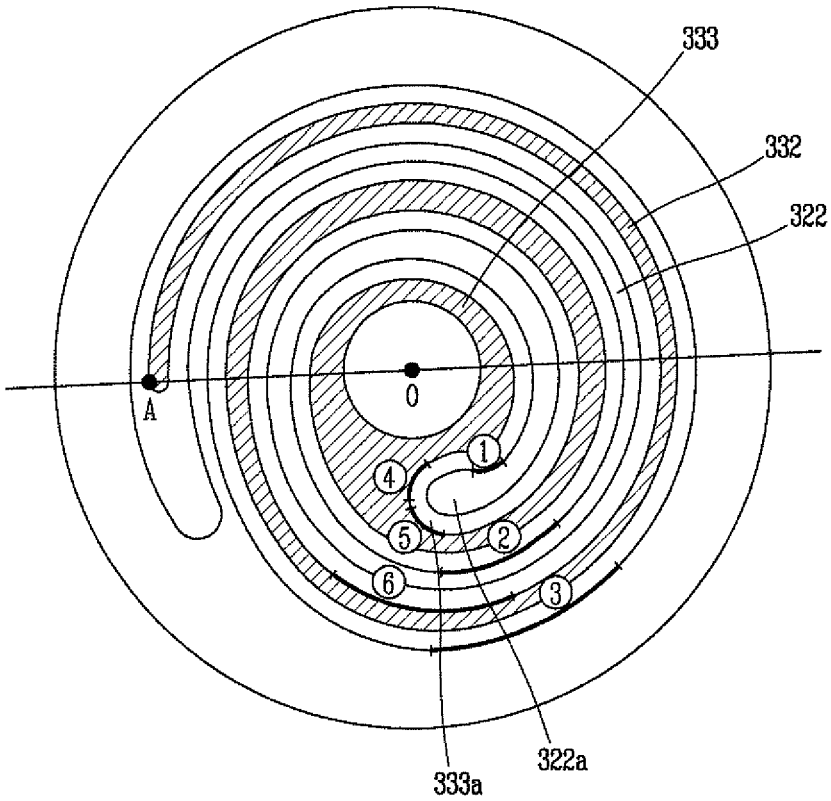
FIG. 4 is a planar view of a fixed wrap and an orbiting wrap each having an irregular wrap curve according to an embodiment.

The interference section and the gap sections may be generated when the fixed wrap 322 and the orbiting wrap 332 have irregularities, namely, when a wrap curve is irregular without any rule, unlike an involute curve or an algebraic spiral curve, which is regular with a predetermined rule. FIG. 4 is a planar view of a fixed wrap and an orbiting wrap having an irregular wrap curve according to an embodiment.

The fixed wrap 322 and the orbiting wrap 332 illustrated in FIG. 4 have a shape for which a plurality of arcs with different radiuses and origin points are connected, and an outermost curve has an approximately oval shape having a major axis and a minor axis. The rotational shaft coupling portion 333 may be formed at a central portion of the orbiting wrap 332 to overlap the orbiting wrap 332 in a radial direction. A concave portion 333*a* may be formed on an outer circumferential surface of the rotational shaft coupling portion 333, and a protrusion 322*a* may be formed at an end of the fixed wrap 322 corresponding to the concave portion 333*a*.

The fixed wrap 322 and the orbiting wrap 332 having such irregular shape may generate the interference section ④ and the gap sections ①, ②, ③, ⑤ and ⑥ therebetween due to an unnatural connection at portions where the arcs having the different radiuses and origin points are connected. More specifically, referring to FIG. 4, based on a line that connects a start point A, which is an outer end of the fixed wrap 322 or the orbiting wrap 332, and a center 0 of each scroll, the interference section ④ and the gap sections ①, ②, ③, ⑤ and ⑥ may be formed at an area at which an end point of the fixed wrap 322 is located.

Figure 5:
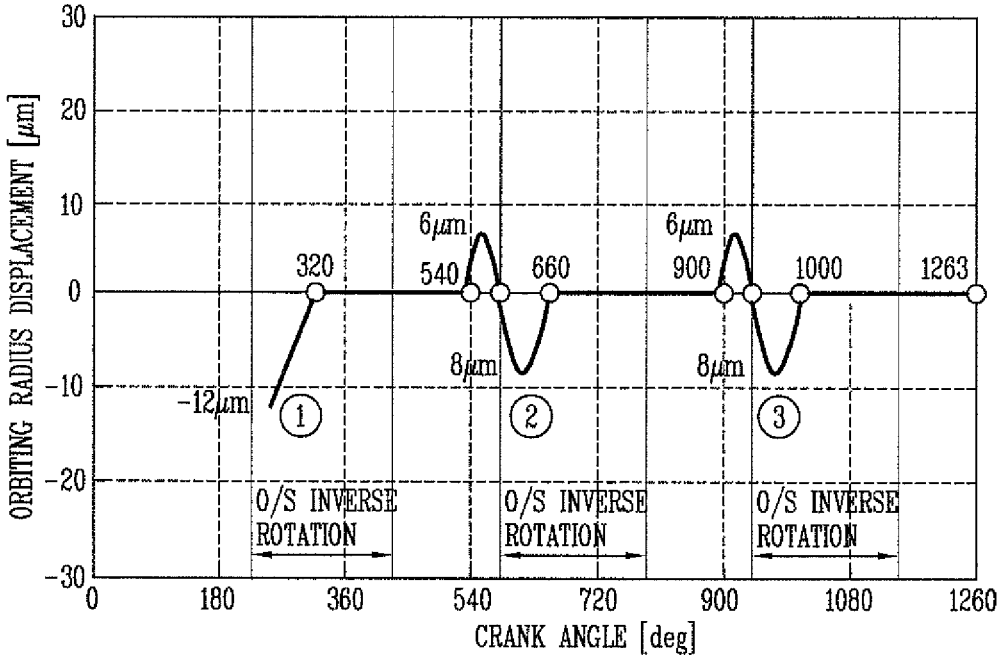
FIG. 5 is a graph illustrating interpretation of an orbiting radius displacement of a gap section with respect to A-path of FIG. 4.
Figure 6:
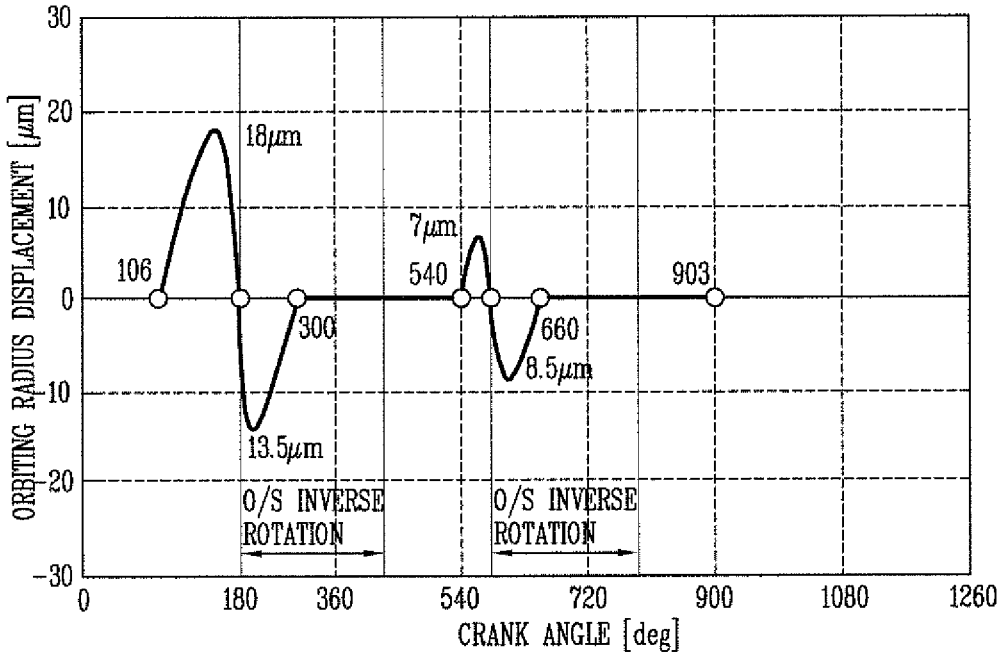
FIG. 6 is a graph illustrating interpretation of an orbiting radius displacement in a gap section with respect to B-path of FIG. 4.

FIGS. 5 and 6 are graphs of a representative example of a gap section illustrating an orbiting radius displacement with respect to an interference section and gap sections between the fixed wrap and the orbiting wrap forming A-path and B-path. FIG. 5 is a graph illustrating interpretation of an orbiting radius displacement of a gap section with respect to A-path of FIG. 4. FIG. 6 is a graph illustrating interpretation of an orbiting radius displacement in a gap section with respect to B-path of FIG. 4. In the graphs, '0' Indicates a state without any interference and gap, '+' indicates a state with interference, and '−' indicates a state with a gap.

As illustrated in FIG. 5, considering a first compression chamber (hereinafter, also referred to as "A-path") formed on an inner surface of the fixed wrap 322, a gap, which may be about 12 μmlong in maximum, may be generated in a vicinity of 200° based on a crank angle. The gap may narrow, and thus, the orbiting radius displacement may become 0 (zero) in the vicinity of 320°. A state of the orbiting radius displacement of 0, which is a state without interference and gap, may be maintained for a predetermined section, and then, interference, which may be about 6 μmlong in maximum may be generated in a section of about 540 to 600°. Then, a gap which may be about 8 μmlong in maximum, may be generated in a section of about 600 to 660°. Afterwards, the orbiting radius displacement becomes 0 again up to about 900°, and then, interference, which is about 6 μmlong in maximum, may be generated up to about 980°. Then, a gap, which is about 8 μmlong in maximum, may be generated up to about 1000°, and thereafter, the orbiting radius displacement of 0 is maintained up to about 1260°, which may be a suction time point.

Also, referring to FIG. 6, considering the second compression chamber (hereinafter, also referred to as "B-path") formed on an inner surface of the orbiting wrap 332, interference, which may be about 18 μmlong in maximum may be generated at a section of about 106° to 180° based on the crank angle, and then, a gap, which may be about 13.5 μmlong in maximum, may be generated again at a section of about 180° to 300°. After the state that the orbiting radius displacement is 0 (zero) may be maintained up to about 540°, interference which may be about 7 mlong in maximum, may be generated at a section of about 540 to 580°, and then, a gap, which may be about 8.5 μmlong in maximum may be generated again at a section of about 580 to 660°. Afterwards, a state that the orbiting radius displacement is 0 (zero) may be maintained up to about 903°. FIGS. 4 to 6 have not illustrated interference and gap less than 2 μm.

Therefore, an interference avoiding portion or a gap compensating portion may be formed at positions at which the interference and gap of A-path and B-path are generated, to offset the interference and the gap between the wraps, thereby preventing frictional loss or abrasion due to the interference between the fixed wrap and the orbiting wrap, and also preventing in advance refrigerant leakage due to the gap. For reference, the interference avoiding portion may be defined as being formed to increase a spacing between wraps to be greater than the orbiting radius while a center of the fixed scroll and a center of the orbiting scroll are aligned with each other, and the gap compensating portion may be defined as being formed to decrease the spacing between the wraps to be smaller than the orbiting radius while the center of the fixed scroll and the center of the orbiting scroll are aligned with each other.

Figure 7:
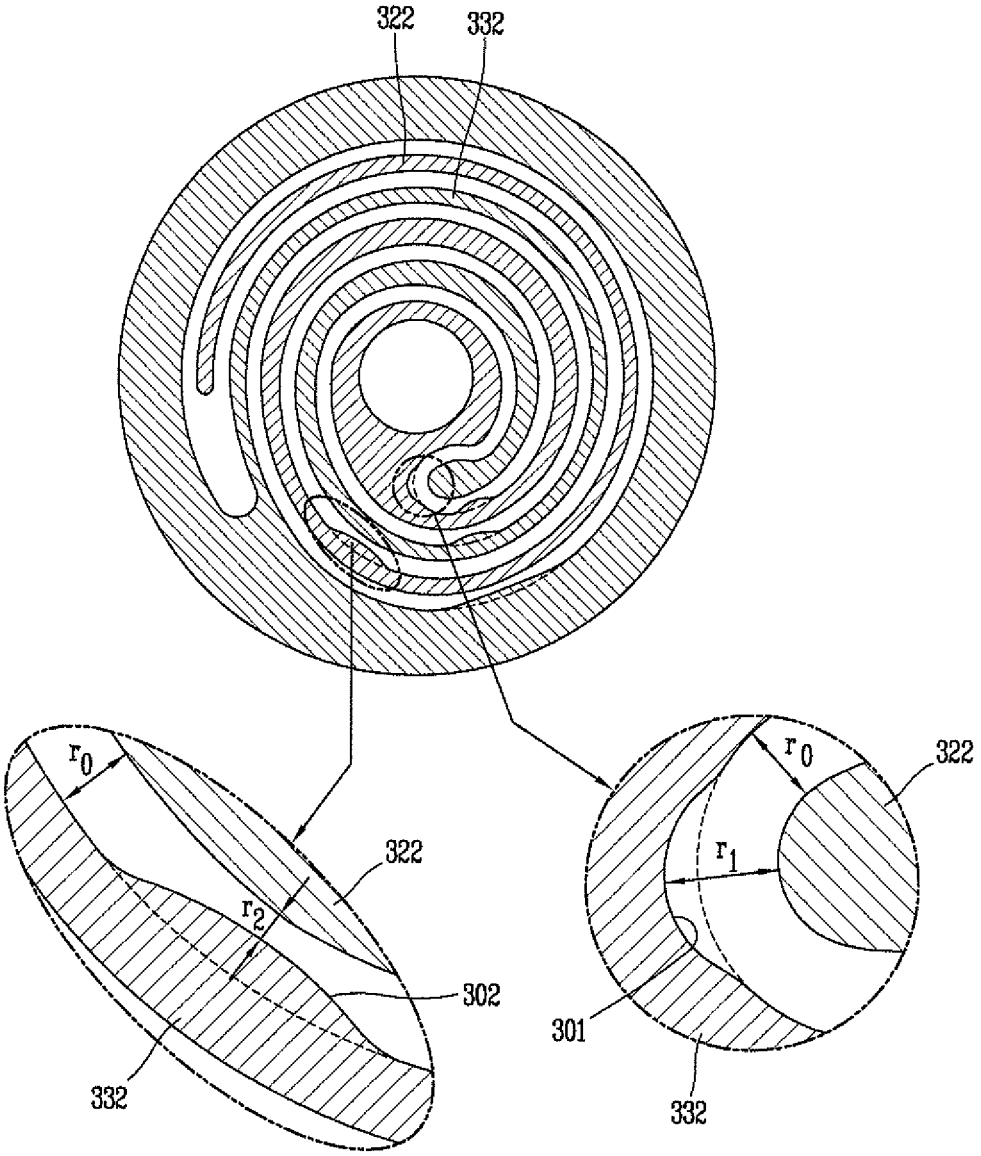
FIG. 7 is a planar view of the B-path as a representative example for illustrating a structure for avoiding interference and a gap between a fixed wrap and an orbiting wrap forming the A-path and the B-path.

FIG. 7 is a planar view of the B-path as a representative example for illustrating a structure for avoiding interference and gap between the fixed wrap and the orbiting wrap forming the A-path and the B-path. As illustrated in FIG. 7, a recess 301 to avoid interference may be formed at each section whether the interference is generated in the orbiting wrap 332 based on the crank angle (for example, a section in the vicinity of 106 to 180°, a section in the vicinity of 540 to 580°; FIG. 7 merely illustrates the section in the vicinity of 106 to 180°). A protrusion 302 for compensating for a gap may be formed at each section where the gap is generated (for example, a section in the vicinity of 180 to 300°, and a section in the vicinity of 580 to 660°). Accordingly, an orbiting radius $r_1$ at the section with the recess 301 may be greater than an original orbiting radius $r_0$, and an orbiting radius $r_2$ at the section with the protrusion 302 is smaller than the original orbiting radius $r_0$.

In such a manner, interference may be avoided at the section at which the interference is generated between the fixed wrap and the orbiting wrap, and simultaneously, the gap may be compensated for at the section at which the gap is generated, thereby preventing frictional loss or abrasion between the wraps, and refrigerant leakage due to the spaced wraps.

A maximum depth of the recess 301 forming the interference avoiding portion and a maximum height of the protrusion 302 forming the interference compensating portion may be the same as or more than at least about 50% of a maximum interference height or a maximum gap height of each section, such that an interference avoiding effect and a gap compensation effect may be expected. In addition, the recess 301 and the protrusion 302 may have a same sectional area in an axial direction of each wrap, such that a gap between the wraps maybe reduced.

Configurations and methods of the compressor according to embodiments may not be limitedly applied, but such embodiments may be configured by a selective combination of all or part of the embodiments so as to implement many variations.

Embodiments disclosed herein provide a scroll compressor capable of preventing abrasion or refrigerant leakage between a fixed wrap and an orbiting wrap in a manner of preventing generation of interference or a gap between the fixed wrap and the orbiting wrap.

Embodiments disclosed herein provide a scroll compressor including a fixed scroll having a fixed wrap, and an orbiting scroll including an orbiting wrap engaged with the fixed wrap to form compression chambers. The fixed wrap and the orbiting wrap may have irregular wrap curves. At least one interference avoiding portion at which a spacing between the wraps is greater than an orbiting radius or at least one gap compensating portion at which a spacing between the wraps is smaller than the orbiting radius, in a state in which a center of the fixed scroll and a center of the orbiting scroll are aligned with each other, may be provided on a sidewall surface of the fixed wrap or the orbiting wrap.

The fixed wrap or the orbiting wrap may have a shape for which a plurality of arcs having different diameters and origin points are connected together, and the interference avoiding portion or the gap compensating portion may be located at each portion at which the arcs having the different diameters and origin points are connected to each other. The interference avoiding portion and the gap compensating portion may be formed at one side area based on a line that connects a start point as an outer end of the fixed wrap or the orbiting wrap and a center of each scroll.

The interference avoiding portion and the gap compensating portion may be formed at an area at which an end point of the fixed wrap is located based on the line. The interference avoiding portion may be formed as a recess on the sidewall surface of the fixed wrap or the orbiting wrap, and the gap compensating portion may be formed as a protrusion on the sidewall surface of the fixed wrap or the orbiting wrap.

The recess or the protrusion may be formed to be more than about 50% of a highest interference height or a highest gap height of each section. The recess or the protrusion may have a same sectional area along a heightwise direction of the wrap.

The orbiting scroll may be coupled in a manner that an eccentric portion of a rotational shaft for orbiting the orbiting scroll overlaps the orbiting wrap in a radial direction.

Embodiments disclosed herein further provide a scroll compressor that may include a casing, a motor unit or motor that is disposed within an inner space of the casing, a frame that is fixedly coupled to the inner space of the casing, a fixed scroll that is fixedly coupled to the frame and has a fixed wrap, and an orbiting scroll that is located between the frame and the fixed scroll and has an orbiting wrap engaged with the fixed wrap to form compression chambers, the orbiting scroll performing an orbiting motion, an Oldham ring that is slidably coupled with the orbiting scroll with a clearance gap therebetween and configured to prevent rotation of the orbiting scroll, and a rotational shaft that is coupled to the orbiting scroll and has an eccentric portion eccentrically coupled to the orbiting scroll. The eccentric portion may overlap the orbiting wrap in a radial direction. The fixed wrap or the orbiting wrap may have at least one section where or at which an orbiting radius is smaller or greater than a preset or predetermined orbiting radius according to a turning direction of each wrap.

A recess to avoid interference may be provided at a section of an orbiting scroll or a fixed scroll, at which the interference is generated, and a protrusion to compensate for a gap may be provided at a section of the orbiting scroll or the fixed scroll, at which the gap is generated. This may result in avoiding interference and compensating for the gap between the wraps, thereby preventing frictional loss or abrasion between the wraps and refrigerant leakage due to the gap between the wrap.

Further scope of applicability of embodiments will become more apparent from the detailed description given herein. However, it should be understood that the detailed description and specific examples, while indicating embodiments, are given by way of illustration only, as various changes and modifications within the spirit and scope will become apparent to those skilled in the art from the detailed description.

As features may be embodied in several forms without departing from the characteristics thereof, it should also be understood that the above-described embodiments are not limited by any of the details of this description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a drive motor located within the casing;

a frame configured to receive a rotational shaft to support the rotational shaft;

a fixed scroll configured to be coupled to the frame and including a fixed wrap;

the rotational shaft connected to the drive motor and provided to pass through the frame and the fixed scroll; and an orbiting scroll configured to be connected to the rotational shaft, the orbiting scroll including a rotational shaft coupling portion configured to rotatably accommodate the rotational shaft, and an orbiting wrap that extends from the rotational shaft coupling portion to engage the fixed wrap, wherein one or more gap compensating portion projects from one surface of one of the fixed wrap or the orbiting wrap toward one surface of the other of the fixed wrap or the orbiting wrap, wherein one or more interference avoiding portion is recessed on one surface of the rotational shaft coupling portion, and wherein the one or more gap compensating portion and the one or more interference avoiding portion are arranged so that they do not face each other in a direction toward the rotational shaft.

2. The scroll compressor of claim 1, wherein the one or more gap compensating portion is provided on the orbiting wrap.

3. The scroll compressor of claim 1, wherein the one or more interference avoiding portion and the one or more gap compensating portion are formed at one side area based on a line that connects a start point at an outer end of the fixed wrap or the orbiting wrap and a center of each scroll.

4. The scroll compressor of claim 3, wherein the one or more interference avoiding portion is formed at an area facing an end point of the fixed wrap.

5. The scroll compressor of claim 1, wherein the one or more interference avoiding portion is formed as a recess adjacent a connection point between the rotational shaft coupling portion and the orbiting wrap, and the one or more gap compensating portion is formed as a protrusion on a sidewall surface of the fixed wrap or the orbiting wrap.

6. The scroll compressor of claim 5, wherein the one or more interference avoiding portion and the one or more gap compensating portion is formed to be more than about 50% of a highest interference height or a highest gap height of each section.

7. The scroll compressor of claim 1, wherein the one or more gap compensating portion and the one or more interference avoiding portion are spaced apart from each other.

8. The scroll compressor of claim 7, wherein the orbiting scroll is coupled in a manner that the rotational shaft that orbits the orbiting scroll overlaps the orbiting wrap in a radial direction.

9. The scroll compressor of claim 1, wherein the one or more interference avoiding portion is provided on the orbiting wrap and faces the end point of the fixed wrap.

10. The scroll compressor of claim 1, wherein the one or more interference avoiding portion is recessed on the orbiting wrap and spaced apart from the end point of the fixed wrap.

11. The scroll compressor of claim 1, wherein the end point of the fixed wrap is thicker than other portions of the fixed wrap.

12. The scroll compressor of claim 1, wherein the interference avoiding portion faces the free end at the end point of the fixed wrap.

13. A scroll compressor, comprising:

a casing;

a motor disposed within an inner space of the casing;

a frame fixedly coupled to the inner space of the casing;

a fixed scroll fixedly coupled to the frame and including a fixed wrap and a suction port provided to allow a fluid to flow in therethrough;

an orbiting scroll located between the frame and the fixed scroll and including an orbiting wrap engaged with the fixed wrap to compress the fluid, wherein the orbiting scroll performs an orbiting motion;

a rotational shaft coupled to the orbiting scroll and including an eccentric portion eccentrically coupled to the orbiting scroll, wherein the eccentric portion overlaps the orbiting wrap in a radial direction, wherein one or more gap compensating portion is configured to project from one surface of one of the fixed wrap or the orbiting wrap toward one surface of the other of the fixed wrap or the orbiting wrap, wherein the one or more gap compensating portion is disposed in an area corresponding to 180 degrees to 300 degrees and/or 380 degrees to 660 degrees in a direction in which the orbiting wrap or the fixed wrap extends inward from the suction port with respect to the rotational shaft, and wherein the one or more gap compensating portion is not disposed in other areas.

14. The scroll compressor of claim 13, wherein the one or more gap compensating portion is disposed on the orbiting wrap.

15. The scroll compressor of claim 13, wherein the end point of the fixed wrap is thicker than other portions of the fixed wrap.

16. The scroll compressor of claim 15, wherein the orbiting scroll is coupled in a manner that the eccentric portion of the rotational shaft that orbits the orbiting scroll overlaps the orbiting wrap in a radial direction.

* * * * *